US005417843A

United States Patent [19]

Swart et al.

[11] Patent Number: 5,417,843

[45] Date of Patent: May 23, 1995

[54] REFORMING WITH TWO FIXED-BED UNITS, EACH HAVING A MOVING-BED TAIL REACTOR SHARING A COMMON REGENERATOR

[75] Inventors: Gerrit S. Swart, Westfield, N.J.; Stuart S. Goldstein, Ewell, England; Paul W. Kamienski, Basking Ridge, N.J.; George A. Swan, III, Baton Rouge, La.

[73] Assignee: Exxon Research & Engineering Co., Florham Park, N.J.

[21] Appl. No.: 245,844

[22] Filed: May 18, 1994

Related U.S. Application Data

[63] Continuation of Ser. No. 7,388, Jan. 21, 1993, abandoned, which is a continuation of Ser. No. 805,331, Dec. 9, 1991, abandoned.

[51] Int. Cl.[6] ..... C10G 35/085

[52] U.S. Cl. ..... 208/65; 208/63; 208/138

[58] Field of Search ..... 208/65, 65, 138

[56] References Cited

U.S. PATENT DOCUMENTS

| | | | |
|---|---|---|---|
| 2,767,124 | 10/1956 | Myers | 208/79 |
| 2,866,745 | 12/1958 | Heinemann | 208/79 |
| 3,013,088 | 12/1961 | Merryfield | 208/79 |
| 3,384,571 | 5/1968 | Engel | 208/79 |
| 3,432,425 | 3/1964 | Bodkin et al. | 208/79 |
| 3,434,571 | 5/1968 | Engel | 208/65 |
| 3,753,891 | 8/1973 | Graven et al. | 208/65 |
| 3,864,240 | 3/1975 | Slone | 208/64 |
| 3,883,418 | 5/1975 | Diehmann et al. | 208/65 |
| 3,992,465 | 11/1976 | Juguin et al. | 208/64 |
| 4,002,555 | 1/1977 | Farnham | 208/79 |
| 4,737,262 | 4/1988 | Frack et al. | 208/65 |
| 4,985,132 | 1/1991 | Moser | 208/65 |
| 5,043,057 | 8/1991 | Boyle | 208/65 |

*Primary Examiner*—Helane Myers
*Attorney, Agent, or Firm*—Henry E. Naylor

[57] ABSTRACT

A process for reforming a gasoline boiling range naphtha stream using a reforming process unit comprised of two independent process units, each of which are operated in two stages. The first stage is operated in a fixed-bed mode and is comprised of a plurality of serially connected fixed bed reactors, and the second stage is operated in a moving bed continuous catalyst regeneration mode. A hydrogen-rich stream is recycled through both stages for each process unit and the moving-bed reforming zones share a common regeneration zone.

7 Claims, 1 Drawing Sheet

REFORMING WITH TWO FIXED-BED UNITS, EACH HAVING A MOVING-BED TAIL REACTOR SHARING A COMMON REGENERATOR

This application is a continuation of application Ser. No. 08/007,388, filed Jan. 21, 1993 now abandoned, which is a continuation of application Ser. No. 805,331, filed Dec. 9, 1991 now abandoned.

FIELD OF THE INVENTION

The present invention relates to a process for reforming a gasoline boiling range naphtha stream using a reforming process unit comprised of two independent process units, each of which are operated in two stages. The first stage is operated in a fixed-bed mode and is comprised of a plurality of serially connected fixed bed reactors, and the second stage is operated in a moving bed continuous catalyst regeneration mode. A hydrogen-rich stream is recycled through both stages for each process unit and the moving-bed reforming zones share a common regeneration zone.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series.

In continuous reforming, the reactors are moving-bed reactors, as opposed to fixed-bed reactors, with continuous addition and withdrawal of catalyst. The catalyst descends through the reactor in an annular bed and is passed to a regeneration zone where accumulated carbon is burned-off. The catalyst continues to flow through the regenerator and is recycled to the reactor.

With the gradual phasing out of lead from the gasoline pool and with the introduction of premium grade lead-free gasoline in Europe and the United States, petroleum refiners must re-evaluate how certain refinery units are run to meet this changing demand for higher octane fuels without the use of lead. Because catalytic reforming units produce product streams which represent the heart of the gasoline pool, demands are being put on these units for generating streams with ever higher octane ratings.

U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$ cut to obtain an aromatics-rich stream.

While such teachings are a step in the right direction, there still remains a need in the art for improved reforming processes which can overcome such disadvantages. There is a 1 so a need in the art for the modification of conventional fixed-bed reforming process units to incorporate some of the advantages of moving-bed reforming units, without having to build an entirely new grass-roots moving-bed unit.

SUMMARY OF THE INVENTION

In accordance with the present invention, there is provided a process for catalytically reforming two gasoline boiling range hydrocarbon reactant streams in the presence of hydrogen in a reforming process unit comprised of two banks of reforming zones wherein each of the reforming zones contains a reforming catalyst comprised of at least one Group VIII noble metal on a refractory support. The catalyst may be either monofunctional or bifunctional. The process comprises:

(a) reforming the reactant streams, each in a separate first reforming stage comprised of one or more serially connected reforming zones containing a fixed-bed of a catalyst comprised of one or more Group VIII noble metals on a refractory support, which one or more reforming zones are operated at reforming conditions which includes a pressure of about 100 to 500 psig, thereby producing a first effluent stream;

(b) passing each first effluent stream to a second reforming stage comprised of a reforming zone which is operated in a moving-bed continuous catalyst regeneration mode wherein the catalyst continually descends through each reforming zone, exits, and is passed to a common regeneration zone where any accumulated carbon is burned-off, and wherein regenerated catalyst is simultaneously recycled to each of the moving-bed reforming zones;

(c) passing the effluent stream from each of said moving-bed reforming zones of said second stage reforming to a separate separation zone wherein a hydrogen-rich gaseous stream is separated and recycled to the lead reforming zone of each first reforming stage; and (d) collecting the remaining liquid reformate streams.

In preferred embodiments, the Group VIII noble metal for catalysts in all stages is platinum.

In still other preferred embodiments of the present invention, the catalyst of the final stage is comprised of platinum and tin on a spherical alumina support material.

BRIEF DESCRIPTION OF THE FIGURE

The sole FIGURE hereof depicts a simplified flow diagram of a preferred reforming process of the present invention. The reforming process unit is comprised of two parallel banks of reforming zones. Each bank is operated in a two stage mode wherein the first stage is comprised of one or more fixed-bed reforming reactors and the second stage is composed of moving-bed continuous catalyst regeneration reactors. The terms "reforming reactors" and "reforming zones" are used interchangeably herein. The overall unit can be thought of as two independently operated fixed-bed semi-regenerative or cyclic reforming units which have been modified so that each has a tail moving-bed reactor which shares a common regenerator.

DETAILED DESCRIPTION OF THE INVENTION

Figure 1:
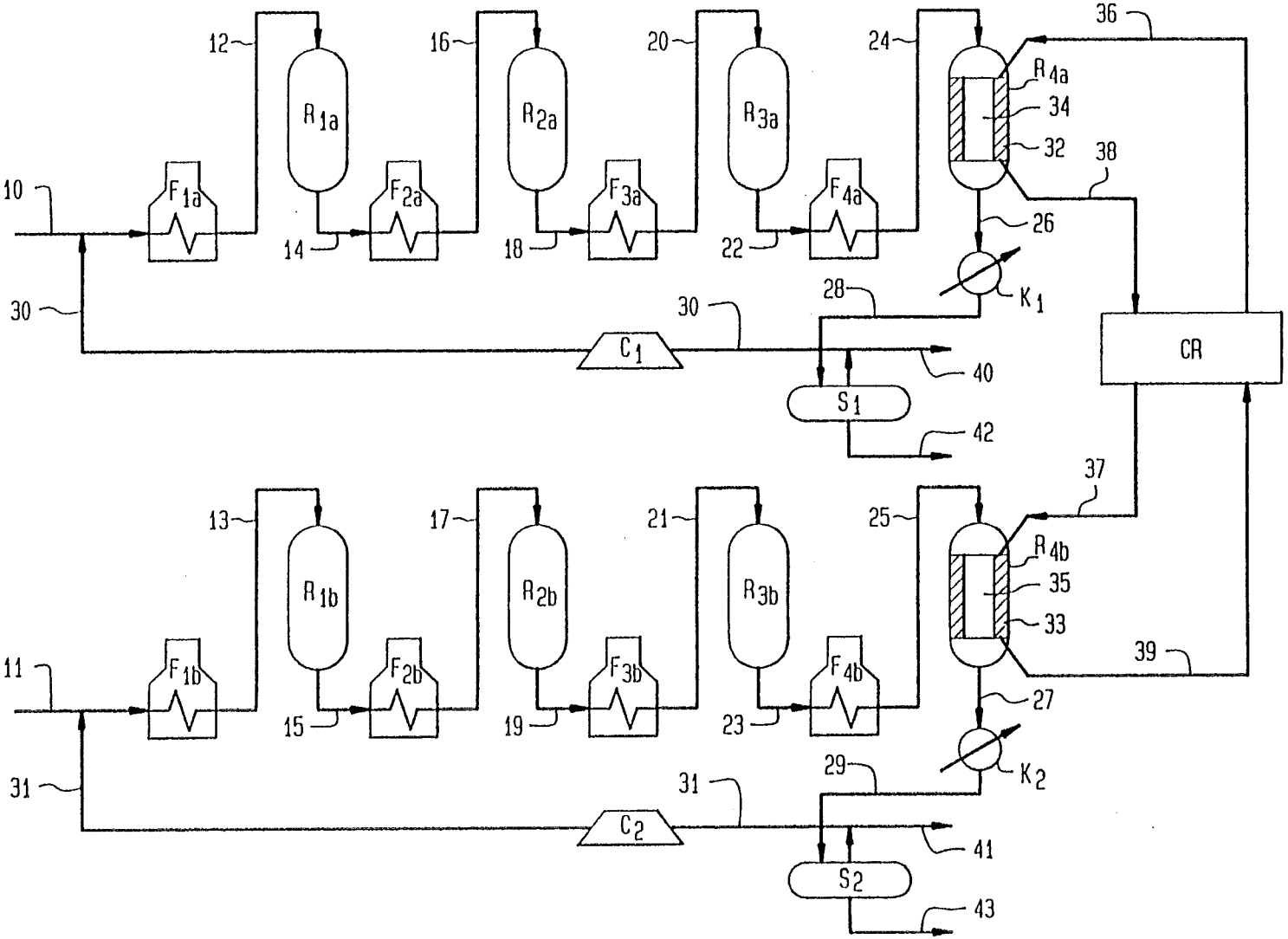

Feedstocks, also sometimes referred to herein as reactant streams, which are suitable for reforming in accordance with the instant invention, are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole FIGURE hereof, two gasoline boiling range hydrocarbon reactant streams, which are preferably first hydrotreated by any conventional hydrotreating method to remove undesirable components such as sulfur and nitrogen, are each passed to a first reforming stage represented by two parallel banks of heater or preheat furnaces $F_{1a}$, $F_{2a}$, $F_{3a}$, and $F_{1b}$, $F_{2b}$, and $F_{3b}$, and reforming zones $R_{1a}$, $R_{2a}$, $R_{3a}$, and $R_{1b}$, $R_{2b}$, and $R_{3b}$ respectively. A reforming stage, as used herein, is any one or more reforming zones of a particular type of reforming reactor, such as fixed-bed or moving-bed reactor, and their associated equipment (e.g., preheat furnaces etc.). The reactant streams are fed into heaters, or preheat furnaces, $F_{1a}$, and $F_{1b}$ via lines 10 and 11 respectively where they are heated to an effective reforming temperature. That is, to a temperature high enough to initiate and maintain dehydrogenation reactions, but not so high as to cause excessive hydrocracking. The heated reactant streams are then fed, via lines 12 and 13, into reforming zones $R_{1a}$ and $R_{1b}$, which contain a catalyst suitable for reforming. Reforming zones $R_{1a}$ and $R_{1b}$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5$+ feed, preferably 1.5 to 5 moles of hydrogen per mole of $C_5$+ feed.

The effluent streams from reforming zones $R_{1a}$ and $R_{1b}$ are fed to preheat furnaces $F_{2a}$ and $F_{2b}$ via lines 14 and 15, then to reforming zones $R_{1a}$ and $R_{1b}$ via lines 16 and 17, then through preheat furnaces $F_{3a}$ and $F_{3b}$ via lines 18 and 19, then to reforming zones $R_{3a}$ and $R_{3b}$ via lines 20 and 21. This concludes first stage reforming in the fixed-bed reactors. The effluent streams from this first stage reforming are sent to the second stage reforming by passing them via lines 22 and 23 to furnaces $F_{4a}$ and $F_{4b}$ then to moving-bed reforming zones $R_{4a}$ and $R_{4b}$ via lines 24 and 25. Each of the effluent streams from the moving-bed reforming zones are sent to cooling zones $K_1$ and $K_2$ via lines 26 and 27, where they are cooled to condense a liquid phase to a temperature within the operating range of the recycle gas separation zones, which is represented in the FIGURE hereof by a separation drums $S_1$ and $S_2$. The temperature will generally range from about 60° to about 300° F., preferably from about 80° to 125° F. The cooled effluent stream is then fed to separation zones $S_1$ and $S_2$ via lines 28 and 29 respectively where each is separated into a hydrogen-rich gaseous stream and a heavier liquid stream. The preferred separation would result in a hydrogen-rich predominantly $C_4$− gaseous stream and a predominantly $C_5$+ liquid stream. It is understood that these streams are not pure streams. For example, the separation zone will not provide complete separation between the $C_4$− components and the $C_5$+ liquids. Thus, the gaseous stream will contain minor amounts of $C_5$+ components and the liquid stream will contain minor amounts of $C_4$− components and hydrogen.

A portion of each of the hydrogen-rich gaseous streams is recycled to the respective fixed-bed reforming units via lines 30 and 31 by first passing them through compressors $C_1$ and $C_2$ respectively, to bring the recycle streams to reforming pressures. About 40 to 90 vol.%, preferably about 50 to 85 vol.%, of the hydrogen-rich gaseous streams will be recycled. Of course, during start-up, the unit is pressured-up with hydrogen from an independent source until enough hydrogen can be generated in the first stage for recycle. The remaining portions of the hydrogen-rich gaseous streams are collected as product gas via lines 40 and 41. The product gas can also be compressed and stored if desired. The predominantly $C_5$+ streams are collected for use in the gasoline pool via lines 42 and 43.

The second stage reforming zones, or reactors, are moving-bed continuous catalyst regeneration reactors, which are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in a annular bed formed by spaced cylindrical screens within the interior of the reactor. The reactant stream is processed through the catalyst bed, typically in an out-to-in radial flow; that is, it enters the reactor at the top and flows radially from the reactor wall through the annular bed of catalyst 32 and 33, which is descending through the reactor, and passes into the cylindrical space 34 and 35 created by said annular bed.

Reforming conditions for the moving-bed reforming zones will include temperatures from about 800° to 1200° F., preferably from about 800° to 1000° F.; pressures from about 30 to 300, preferably from about 50 to 150 psig; a weight hourly space velocity from about 0.5 to 20, preferably from about 0.75 to 6. Hydrogen-rich gas should be provided to maintain the hydrogen to oil ratio between the range of about 0.5 to 5, preferably from about 0.75 to 3. In the preferred embodiment, all of the hydrogen gas is supplied by the hydrogen-rich predominantly $C_4^-$ gaseous stream. Instances may exist in which the gas flowing from the first stage is insufficient to supply the needed hydrogen to oil ratio. This could occur if the feedstock to the first stage was highly paraffinic or had a boiling range which included predominantly hydrocarbons in the 6 to 8 carbon number range. In these instances, hydrogen would need to be supplied from external sources such as a second reforming unit or a hydrogen plant.

Fresh or regenerated catalyst is charged to reforming zones $R_{4a}$ and $R_{4b}$ by way of line 36 and 37 and distributed in the annular moving bed 34 and 35 by means of catalyst transfer conduits, not shown. The catalyst being processed downwardly as an annular dense-phase moving bed. The reforming catalyst charged to reforming zones $R_{4a}$ and $R_{4b}$ are comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the density in bulk of this solid being from about 0.5 to 0.9 and more particularly from about 0.5 to 0.8.

The catalyst of reforming zones $R_{4a}$ and $R_{1b}$ descends through the reforming zones and exits and is passed to a catalyst regeneration zone CR via lines 38 and 39 where accumulated carbon is burned-off at conventional conditions. The catalyst regeneration zone CR represents all of the steps required to remove at least a portion of the carbon from the catalyst and return it to the state needed for the reforming reactions occurring in reforming zones $R_{4a}$ and $R_{4b}$. The specific steps included in the catalyst regeneration zone CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone. The regenerated catalyst is then charged to reforming zone $R_{4a}$ and $R_{4b}$ via lines 36 and 37 and the cycle of continuous catalyst regeneration is continued until the entire reforming unit (both stages) is shut down, such as for catalyst regeneration of first stage reforming, for example when the first stage fixed-bed reforming zones are operated in a semi-regenerative mode.

The moving-bed zones of the second stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery to the center or from the center to the periphery interconnected by catalyst zones of relatively small sections, the reactant stream issuing from one catalyst zone of large section may be divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving bed of catalyst, said zones, as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift". The fluid of the lift used for conveying the catalyst may be any convenient gas, for example nitrogen or still for example hydrogen and more particularly purified hydrogen or recycle hydrogen.

Catalysts suitable of use in any of the reactors of any of the stages include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

By practice of the present invention, reforming is conducted more efficiently and results in increased hydrogen and $C_5$+ liquid yields. The first stage reactors are fixed-bed reactors operated at conventional reforming temperatures and pressures in semiregenerative or cyclic mode while the reactors of the second stage are moving bed reactors operated substantially at lower pressures. The second stage reforming zones will typically be operated at least about 50 psig lower in pressure than those of the first stage. Such pressures in the second stage may be from as low as about 30 psig to about 100 psig. More particularly, the downstream reactors can be operated in once-through gas mode because there is an adequate amount of hydrogen generated, that when combined with the hydrogen-rich gas stream from the first stage, is an adequate amount of hydrogen to sustain the reforming reactions taking place.

The second stage reactors, when operated in a once-through hydrogen-rich gas mode, permit a smaller product-gas compressor ($C_2$ in the FIGURE) to be substituted for a larger capacity recycle gas compressor. Pressure drop in the second stage is al so reduced by virtue of once-through gas operation. Of course, the second stage reactors can be operated in a mode wherein the hydrogen-rich gas is recycled.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming two gasoline boiling range hydrocarbon reactant streams in the presence of hydrogen in a reforming process unit comprised of two banks of reforming zones wherein each of the reforming zones contains a reforming catalyst comprised of at least one Group VIII noble metal on an alumina support, which process comprises:

(a) reforming the reactant streams, each in a separate first reforming stage comprised of one or more serially connected reforming zones containing a fixed-bed of a catalyst comprised of one or more Group VIII noble metals on a refractory support, which one or more reforming zones are operated at reforming conditions which includes a pressure of about 100 to 500 psig, thereby producing a first effluent stream;

(b) passing each first effluent stream to a separate, non-common downstream second reforming stage comprised of a reforming zone which is operated in a moving-bed mode wherein catalyst continually descends through each moving-bed reforming zone, exits each moving-bed reforming zone, and is simultaneously passed to a common regeneration zone where any accumulated carbon is burned-off, and wherein regenerated catalyst is simultaneously recycled to each of the moving-bed reforming zones;

(c) passing the effluent streams from each moving-bed reforming zone of said second stage reforming to a separate separation zone wherein a hydrogen-rich gaseous stream is separated and recycled to the lead reforming zone of each first reforming stage; and (d) collecting the remaining liquid reformate streams.

2. The process of claim 1 wherein the catalyst in each of the reforming zones of the first stage is comprised of about 0.01 to 5 wt. % platinum, and about 0.01 to 5 wt. % of at least one metal selected from the group consisting of iridium, rhenium, and tin.

3. The process of claim 1 wherein the catalyst of each of the reforming zones of the second stage is comprised of about 0.01 to 5 wt. % platinum, 0.01 to 5 wt. % tin, on substantially spherical particles of a refractory support.

4. The process of claim 3 wherein the amount of platinum and tin are each from about 0.1 to 2 wt. % and the spherical refractory support particles are comprised of alumina.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim 1 wherein: (i) the first reforming stage contains 2 or 3 fixed-bed reforming zones for each fixed-bed process unit, and (ii) the second reforming stage contains one or two moving-bed reforming zones, with the proviso that when two moving-bed reforming zones are employed, the catalyst descends through a first moving-bed reforming zone, is passed to the second moving-bed reforming zone where it descends through said second moving-bed reforming zone, then is passed to a regeneration zone where any accumulated carbon is burned-off, after which the regenerated catalyst is recycled to said first moving-bed reforming zone.

7. The process of claim 6 wherein: (i) the catalyst in each reforming zone of said first reforming stage is comprised of about 0.01 to 5 wt. % platinum, about 0.01 to 5 wt. % of at least one metal selected from the group consisting of iridium, rhenium, and tin; and (ii) the catalyst in each of the reforming zones of said second stage is comprised of about 0.1 to 2 wt. % platinum, and about 0.1 to 2 wt. % tin on substantially spherical refractory support.

* * * * *